US007762338B2

(12) United States Patent
Fenton et al.

(10) Patent No.: US 7,762,338 B2
(45) Date of Patent: Jul. 27, 2010

(54) ORIENTATION-LESS ULTRA-SLIM WELL AND COMPLETION SYSTEM

(75) Inventors: Stephen P. Fenton, Balmedie (GB); Lars-Petter Sollie, Satre (NO); Andrew Davidson, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 979 days.

(21) Appl. No.: 11/507,410

(22) Filed: Aug. 21, 2006

(65) Prior Publication Data

US 2007/0039738 A1 Feb. 22, 2007

Related U.S. Application Data

(60) Provisional application No. 60/709,521, filed on Aug. 19, 2005.

(51) Int. Cl.
*E21B 23/00* (2006.01)

(52) U.S. Cl. ..... 166/348; 166/382; 166/250.01; 166/365; 166/368

(58) Field of Classification Search ..... 166/368, 166/338–341, 344, 345, 351, 360, 367, 378, 166/380, 382
See application file for complete search history.

(56) References Cited

U.S. PATENT DOCUMENTS

| | | | | |
|---|---|---|---|---|
| 4,095,421 | A * | 6/1978 | Silcox | 60/398 |
| 4,647,254 | A * | 3/1987 | Baugh et al. | 405/169 |
| 4,852,648 | A * | 8/1989 | Akkerman et al. | 166/66.4 |
| 5,666,050 | A * | 9/1997 | Bouldin et al. | 324/207.26 |
| 6,343,654 | B1 * | 2/2002 | Brammer | 166/338 |
| 6,359,569 | B2 * | 3/2002 | Beck et al. | 340/856.3 |
| 6,478,087 | B2 * | 11/2002 | Allen | 166/255.1 |
| 6,513,596 | B2 * | 2/2003 | Wester | 166/336 |
| 6,536,529 | B1 * | 3/2003 | Kerr et al. | 166/375 |
| 6,693,554 | B2 * | 2/2004 | Beique et al. | 340/856.3 |
| 6,725,924 | B2 * | 4/2004 | Davidson et al. | 166/250.01 |
| 6,747,569 | B2 * | 6/2004 | Hill et al. | 340/855.8 |
| 7,073,594 | B2 * | 7/2006 | Stegemeier et al. | 166/369 |
| 7,114,571 | B2 * | 10/2006 | Gatherar et al. | 166/367 |
| 7,156,169 | B2 * | 1/2007 | Bartlett | 166/66.7 |
| 7,261,162 | B2 * | 8/2007 | Deans et al. | 166/336 |
| 7,274,989 | B2 * | 9/2007 | Hopper | 702/6 |

(Continued)

FOREIGN PATENT DOCUMENTS

| | | |
|---|---|---|
| WO | WO 01/65063 A1 | 9/2001 |

(Continued)

*Primary Examiner*—Thomas A Beach
*Assistant Examiner*—Matthew R Buck
(74) *Attorney, Agent, or Firm*—Bracewell & Giuliani

(57) ABSTRACT

An assembly for landing a tubing hanger in a subsea well includes a riser extending from a subsea wellhead assembly to a vessel at the surface of the sea. A tubing hanger having a string of tubing suspended therefrom is lowered through the riser with a string of conduit, and the tubing hanger lands within the subsea wellhead assembly. A sensor is positioned adjacent the subsea wellhead assembly to monitor the axial position of the tubing hanger within the subsea wellhead assembly. The sensor also communicates the axial position of the tubing hanger to the surface. A locking mechanism is carried by the tubing hanger and is selectively operable to lock the tubing hanger in place relative to the subsea wellhead assembly when the tubing hanger reaches a predetermined axial location.

19 Claims, 4 Drawing Sheets

U.S. PATENT DOCUMENTS

| | | | | |
|---|---|---|---|---|
| 7,318,480 | B2 * | 1/2008 | Hosie et al. | 166/367 |
| 7,513,308 | B2 * | 4/2009 | Hosie et al. | 166/338 |
| 2001/0027865 | A1 * | 10/2001 | Wester | 166/250.01 |
| 2002/0189806 | A1 * | 12/2002 | Davidson et al. | 166/250.01 |
| 2003/0047317 | A1 * | 3/2003 | Powers | 166/373 |

FOREIGN PATENT DOCUMENTS

| | | | |
|---|---|---|---|
| WO | WO 02/063341 | A1 | 8/2002 |

* cited by examiner

ORIENTATION-LESS ULTRA-SLIM WELL AND COMPLETION SYSTEM

RELATED APPLICATION

This nonprovisional application claims the benefit and priority of provisional patent application U.S. Ser. No. 60/709,521, filed on Aug. 19, 2005, which is hereby incorporated by reference in its entirety.

BACKGROUND OF THE INVENTION

1. Field of the Invention

This invention relates in general to offshore drilling, and in particular to equipment and methods for running conduit with an offshore rig.

2. Background of the Invention

When drilling subsea wells, a low pressure wellhead housing is installed with a string of conductor casing or pipe extending therefrom into the sea floor. A high pressure wellhead housing is then landed in the bore of the low pressure wellhead housing with another string casing extending therefrom to a deeper depth. Additional strings of casing that extend deeper into the subsea well, until at least one string reaches a production depth, are suspended from casing hangers landed within the bore of the high pressure housing. A tubing hanger is then landed for supporting a string of production tubing that receives the hydrocarbons from the subsea well after the deepest string of casing is perforated.

Typically, the tubing hanger is lowered into the subsea wellhead assembly through a riser extending from a vessel at the surface. In previous systems, the tubing hanger had downward facing shoulders that would land on an upward facing support within the subsea housing. The downward facing shoulders typically increased the outer diameter of the tubing hanger, and thus also increased the minimum allowable diameter of the riser through which the tubing hanger was lowered. In other previous systems, the retractable locking assemblies were located on the outer periphery of the tubing hanger so that the outer diameter of the tubing hanger was smaller than previous tubing hangers. These locking assemblies were typically actuated mechanically when landing within the subsea wellhead housing by profiles formed in the subsea wellhead assembly that would engage and actuate the locking assembly radially outward to land upon the support surfaces in the subsea wellhead assembly. However, these assemblies required the tubing hanger to be oriented properly for such actuation to occur.

SUMMARY OF THE INVENTION

An assembly for landing a tubing hanger in a subsea well includes a riser extending from a subsea wellhead assembly to a vessel at the surface of the sea. A tubing hanger having a string of tubing suspended therefrom is lowered through the riser with a string of conduit, and the tubing hanger lands within the subsea wellhead assembly. A sensor is positioned adjacent the subsea wellhead assembly to monitor the axial position of the tubing hanger within the subsea wellhead assembly. The sensor also communicates the axial position of the tubing hanger to the surface. A locking mechanism is carried by the tubing hanger and is selectively operable to lock the tubing hanger in place relative to the subsea wellhead assembly when the tubing hanger reaches a predetermined axial location.

The sensor can have a receiver attached to an outer periphery of the riser. Alternatively, the sensor can also be carried by a remote operated vehicle.

In the assembly, the subsea wellhead assembly can also include a wellhead housing having a grooved profile formed in an inner bore thereof. The locking mechanism can also have a plurality of locking members or locking dogs positioned within an annular groove formed in the outer circumference of the tubing hanger. The locking members can have a lock profile that matingly engages the grooved profile when the locking members are actuated radially outward.

In the assembly, the locking mechanism can include an electrically-actuated solenoid in electrical communication with the vessel. The solenoid can have an extended position and a contracted position. The locking mechanism can also have a plurality of locking members that matingly engage an interior surface of the wellhead housing assembly when actuated radially outward by the solenoid when the solenoid moves to the extended position. The solenoid can be in the contracted position until the tubing hanger is lowered to the predetermined axial position, and the solenoid can be actuated to its extended position with an electrical current from the surface.

The assembly can also include a remote operated vehicle positioned adjacent the subsea wellhead assembly with an acoustical transmitter that selectively transmits an acoustical wave into the subsea wellhead assembly. Also in the assembly, the locking mechanism can have an accoustically-actuated solenoid that has an extended position and a contracted position. The locking mechanism can also have a plurality of locking members that matingly engage an interior surface of the wellhead housing assembly when actuated radially outward by the solenoid when the solenoid moves to the extended position. The solenoid can be in the contracted position until the tubing hanger is lowered to the predetermined axial position and the solenoid can be actuated to its extended position when the acoustic wave is transmitted into the subsea wellhead assembly.

The assembly can also include a controller on the vessel. The controller can have a power source and a modem. The controller having a first source terminal connecting to the string of conduit and a second source terminal connecting to the riser. The assembly can also include a conductor positioned on the outer surface of the string of tubing that can engage an interior surface of the subsea wellhead assembly to thereby define an electrical circuit for supplying power from the vessel to the sensor, the axial position transmitter, and the locking mechanism.

An assembly for landing a tubing hanger in a subsea well can also have a riser extending from a subsea wellhead assembly to a vessel at the surface of the sea. A tubing hanger with a string of tubing suspended therefrom is lowered through the riser with a string of conduit, and lands within the subsea wellhead assembly. An axial position transmitter is positioned adjacent the tubing hanger, and is in electrical communication with the vessel. The axial position transmitter transmits an axial position signal while being lowered through the riser and subsea wellhead assembly. A sensor is positioned adjacent the subsea wellhead assembly. The sensor receives the axial position signal and communicates the axial position of the axial position transmitter within the subsea wellhead assembly to the surface. A locking mechanism is carried by the tubing hanger, and is selectively operable to lock the tubing hanger in place relative to the subsea wellhead assembly when the axial position transmitter reaches a predetermined axial location.

The sensor can have a receiver attached to an outer periphery of the riser. Alternatively, the sensor can also be carried by a remote operated vehicle.

The assembly can also include a remote operated vehicle that is positioned adjacent the subsea wellhead assembly, and has an acoustical transmitter that selectively transmits an acoustical wave into the subsea wellhead assembly. In the assembly, the locking mechanism can also include an accoustically-actuated solenoid having an extended position and a contracted position. The locking mechanism can further include a plurality of locking members that can matingly engage an interior surface of the wellhead housing assembly when actuated radially outward by the solenoid when the solenoid moves to the extended position. The solenoid can be in the contracted position until the tubing hanger is lowered to the predetermined axial position, and the solenoid can be actuated to its extended position when the acoustic wave is transmitted into the subsea wellhead assembly.

The assembly can further include that the remote operated vehicle includes a stab and an electric coil housed within the stab. The electric coil can transmit a plurality of magnetic waves into the subsea wellhead housing. The sensor can receive reflections of the magnetic field waves responsive to the tubing hanger being lowered into the subsea wellhead assembly in order to determine the axial position of the tubing hanger. The assembly can further include that the tubing hanger can be connected to the string of conduit with a tubing hanger running tool having a smaller outer diameter than the tubing hanger. The sensor can receive a variation in the reflections of magnetic waves reflecting from the outer surface of the tubing than from the outer wall of the tubing hanger running tool, thereby signaling when the tubing hanger is in the predetermined axial position. Alternatively, the assembly can include that the axial position transmitter comprises a magnetized material. The sensor can receive a variation in the reflections of magnetic waves reflecting from the outer surface of the tubing than from the magnetized material of the axial position transmitter to signal when the tubing hanger is in the predetermined axial position.

In the assembly, the subsea wellhead assembly can include a wellhead housing having a grooved profile formed in an inner bore thereof. The locking mechanism can also include a plurality of inwardly-biased locking members positioned within an annular groove formed in the outer circumference of the tubing hanger. The locking members can have a lock profile that matingly engages the grooved profile when the locking members are actuated radially outward. The locking mechanism can also include a lock cam that is selectively movable between upper and lower positions. The lock cam can have an inclined surface that engages the locking members to actuate the locking members radially outward when the lock cam moves to the upper position. The assembly can further include that the locking mechanism also has an electrically-actuated solenoid in electrical communication with the vessel. The solenoid can be in contact with the lock cam to selectively move the lock cam between the upper and lower positions when the solenoid actuates between an extended position and a contracted position. The locking members can be actuated radially outward by the lock cam when the solenoid actuates to the extended position and moves the lock cam to its upper position. The solenoid can be in the contracted position until the tubing hanger is lowered to the predetermined axial position. The solenoid can be actuated to its extended position with an electrical current from the surface.

The assembly can also include a controller on the vessel. The controller can have a power source and a modern. The controller can have a first source terminal connecting to the string of conduit and a second source terminal connecting to the on the riser. The assembly can also have a conductor positioned on the outer surface of the string of tubing that engages an interior surface of the subsea wellhead assembly, which can thereby define an electrical circuit for supplying power from the vessel to the sensor and the locking mechanism.

The modem can receive signals from the sensor pertaining to the axial position of the tubing hanger within the subsea wellhead assembly. The modem can be used for communicating electric signals to the solenoid in order to actuate the solenoid when the tubing hanger is in the predetermined axial position.

A method of landing a tubing hanger in a subsea well includes the step of extending a riser from a subsea wellhead assembly to a vessel at the surface of the sea. A tubing hanger having a string of tubing suspended therefrom is then lowered with a string of conduit through the riser to within the subsea wellhead assembly. The axial position of the tubing hanger within the subsea wellhead assembly is monitored with a sensor positioned adjacent the subsea wellhead assembly. The axial position of the tubing hanger is communicated to the surface with the sensor. The tubing hanger is locked in place relative to the subsea wellhead assembly when the tubing hanger reaches a predetermined axial location, with a locking mechanism carried by the tubing hanger.

In the method, the locking of the tubing hanger step can be performed by actuating a solenoid to an extended position, which causes a plurality of inwardly-bias locking members to move radially outward and engage an interior surface of the subsea wellhead assembly.

In the method, lowering of the tubing hanger step can also include providing an axial position transmitter adjacent the tubing hanger and that is carried by the string of conduit. The lowering of the tubing hanger step can also include transmitting signals to the receiver with the axial position transmitter as the tubing hanger and the axial position transmitter are lowered through the riser and the subsea wellhead assembly.

DETAILED DESCRIPTION OF THE PREFERRED EMBODIMENT

Figure 1:
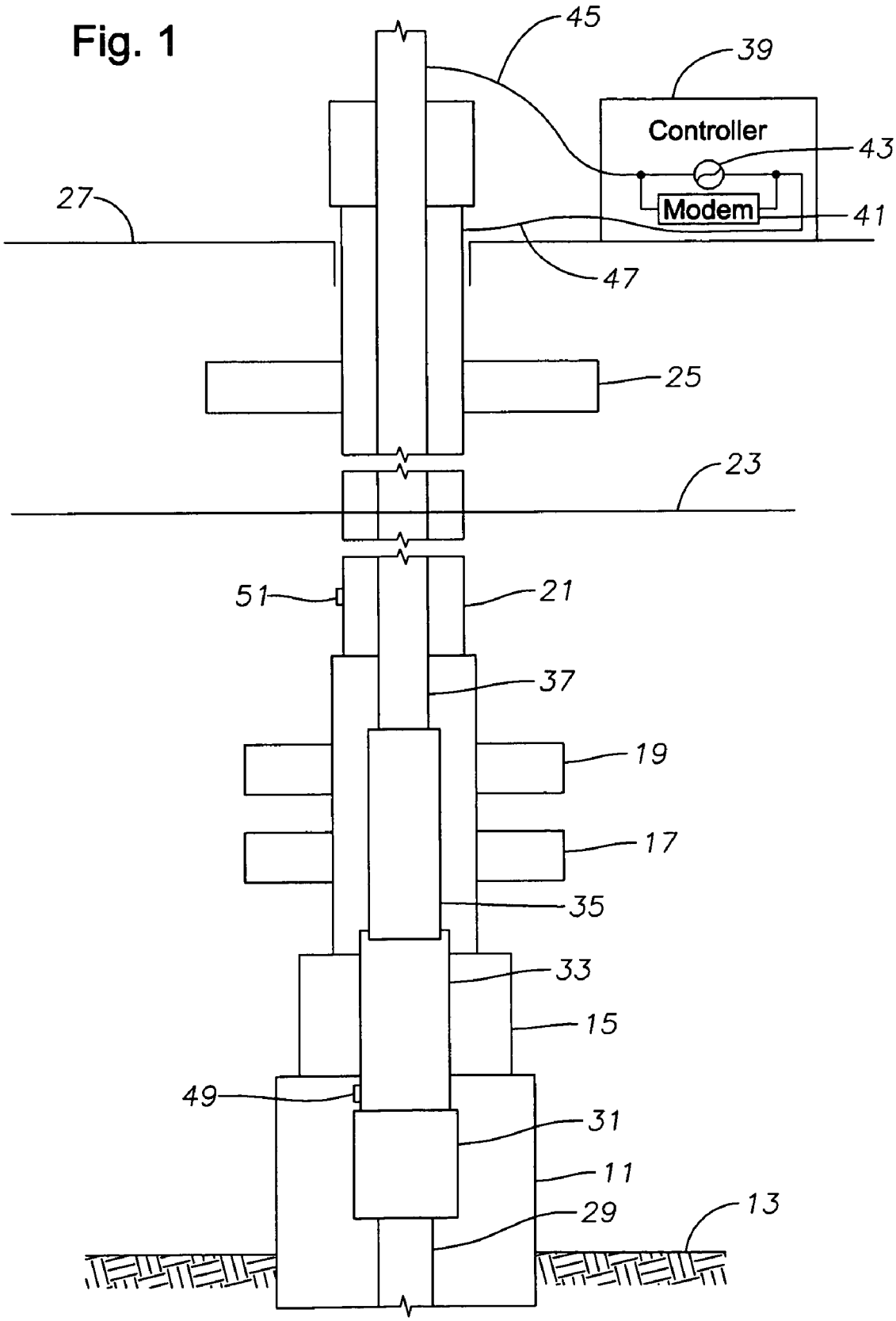
FIG. 1 is a schematic view of a tubing hanger being run through a riser and wellhead system in accordance with an embodiment of this invention.

Referring to FIG. 1, a wellhead 11 is schematically shown located at sea floor 13. Wellhead 11 may be a wellhead housing, a tubing hanger spool, or a Christmas tree of a type that supports a tubing hanger within. An adapter 15 connects wellhead 11 to a subsea set of pipe rams 17. Pipe rams 17 will seal around pipe of a designated size range but will not fully close access to the well if no pipe is present. The subsea pressure control equipment also includes a set of shear rams 19 in the preferred embodiment. Shear rams 19 are used to completely close access to the well in an event of an emergency, and will cut any lines or pipe within the well bore. Pipe rams 17, 19 may be controlled by ultrasonic signals or they may be controlled by an umbilical leading to the surface.

A riser 21 extends from shear rams 19 upward. Most drilling risers use flanged ends on the individual riser pipes that bolt together. Riser 21, on the other hand, preferably utilizes casing with threaded ends that are secured together, the casing being typically smaller in diameter than a conventional drilling riser. Riser 21 extends upward past sea level 23 to a blowout prevent ("BOP") stack 25. BOP stack 25 is an assembly of pressure control equipment that will close on the outer diameter of a size range of tubular members as well as fully close when a tubular member is not located within. BOP stack 25 serves as the primary pressure control unit for the drilling and completion operation.

Riser 21 and BOP stack 25 are supported by a tensioner (not shown) of a floating vessel or platform 27. Platform 27 may be of a variety of types and will have a derrick and drawworks for drilling and completion operations.

FIG. 1 illustrates a string of production tubing 29 lowered into the well below wellhead 11. A tubing hanger 31, secured to the upper end of production tubing 29, lands in wellhead 11. A tubing hanger running tool 33 releasably secures to tubing hanger 31 for running and locking it to wellhead 11, and for setting a seal between tubing hanger 31 and the inner diameter of wellhead 11. Tubing hanger running tool 33 typically includes a quick disconnect member 35 on its upper end that extends through rams 17, 19. Rams 17 will be able to close and seal on disconnect member 35. Disconnect member 35 is secured to the lower end of a string of conduit 37, which may also be tubing or it could be drill pipe. Disconnect member 35 allows running tool 33 to be disconnected from conduit 37 in the event of an emergency. While tubing hanger 31 is described herein as that for hanging tubing 29, those readily skilled in the art will readily appreciate that a casing hanger and a string of casing are interchangeable within the scope of this invention with tubing hanger 31 and tubing 29 associate therewith.

In the preferred embodiment, a controller 39 is positioned on platform 27. Controller 39 is for controlling downhole activities, including landing tubing hanger 31, and sending and receiving signals from downhole sensors and transmitters. Controller 39 includes a modem 41 for sending and receiving the signals to the downhole sensors and transmitters, and a power supply 43 for transmitting power to downhole. Controller 39 is preferably positioned adjacent an upper portion of riser 21. A first source terminal 45 extends between controller 39 and conduit 37 so that controller 39 is in electrical communication with conduit 37. A second source terminal 47 extends between controller 39 and riser 21 so that controller 39 is in electrical communication with riser 21. In the preferred embodiment, second source terminal 47 acts as an electrical ground when there is a closed electrical circuit including conduit 37 and riser 21.

Figure 2:
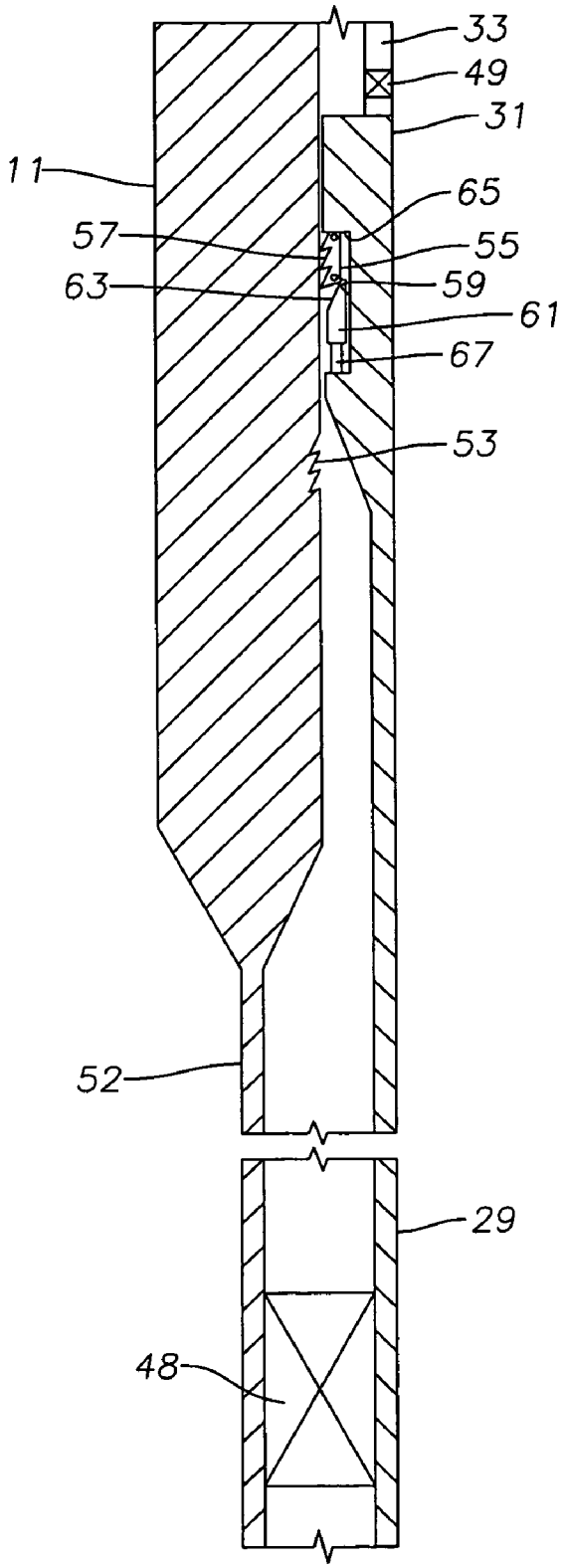
FIG. 2 is a schematic vertical view a portion of the tubing hanger and the riser and wellhead system of FIG. 1.

Referring to FIG. 2, a conductor 48 is positioned between production tubing 29 and a string of casing 52 extending downward from wellhead 11. Conductor 48 advantageously closes an electrical circuit that includes controller 39, conduit 37, and riser 21 so that modem 41 and power supply 43 are in electrical communication with downhole equipment located above conductor 48. As will be readily appreciated by those skilled in the art, conductor 48 can be several devices that have a desired conductivity in order to close an electrical circuit. For example, conductor 48 can be centralizers to aid in the landing of production tubing 29. Conductor 48 can also be a brush ring with metallic bristles that attaches to the outer circumference of production tubing 29.

Referring to FIGS. 1 and 2, a receiver 51 is preferably positioned on riser 21 in electrical communication with controller 39. In the embodiment shown in FIGS. 1 and 2, an axial position transmitter 49 that is positioned on tubing hanger running tool 33 transmits a signal when the electrical circuit including controller 39, conduit 37, conductor 48, and riser 21 is closed. Receiver 51 receives the signal from axial position transmitter 49 and conveys that signal to controller 39 and modem 41.

As best shown in FIG. 2, a grooved profile 53 is formed on an inner surface of wellhead 11. In the preferred embodiment, tubing hanger 31 engages grooved profile 53 when landing in wellhead 11. At least one, and preferably a plurality of suspension dogs 55 are positioned along an outer circumference of tubing hanger 31. A counter-oriented grooved profile 57 is preferably formed on suspension dogs 55 for engaging grooved profile 53 of wellhead 11. Suspension dogs 55 are preferably located within an annular groove 59 formed along an outer circumference of tubing hanger 31. Dogs 55 are selectively moveable between a radially inward position within annular groove 59 (FIGS. 2 and 3) and a radially outward position (FIG. 4).

Figure 3:
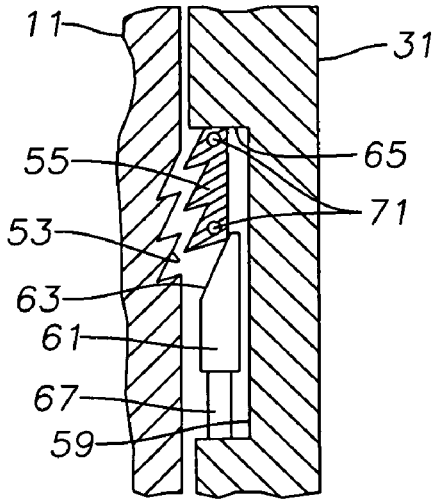
FIG. 3 is an enlarged schematic view of the portion of the tubing hanger and the riser and wellhead system of FIG. 2 in an unlocked position.
Figure 4:
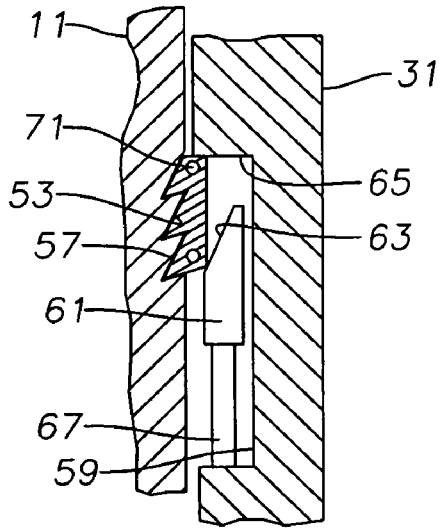
FIG. 4 is an enlarged schematic view of the portion of the tubing hanger and the riser and wellhead system of FIG. 2 in a locked and landed position.

Referring to FIGS. 2-4, a cam 61 is located within annular groove 59, in contact with dogs 55. Cam 61 has an inclined face 63 that slidingly engages a lower portion of dogs 55. An upper portion of dogs 55 engages a downward facing surface 65 formed by annular groove 59. Inclined face 63 extends so that cam 61 is narrower near its upper portion, and wider near its lower portion.

A solenoid 67 is positioned within annular groove 59, between an upward facing ledge 69 of annular groove 59 and a lower surface of cam 61. Solenoid 67 is in electrical communication with controller 39, which electronically actuates solenoid 67 between a contracted position shown in FIG. 3 and an expanded position shown in FIG. 4. An O-ring or retention spring 71 extends circumferentially around annular groove 59 through dogs 55. Retention spring 71 biases dogs 55 radially inward within annular groove 59.

In operation, tubing hanger 31 with the string of production tubing 29 hanging therefrom is lowered into the bore of wellhead 11 and casing 52. Suspension dogs 55 are preferably radially inward, solenoid 61 being in the contracted position illustrated in FIGS. 2 and 3. Controller 39 is in electrical communication with production tubing 29 through first source terminal 45, and with casing 52 through second source terminal 47. An electrical circuit is closed when production tubing 29 and casing 52 are both in contact with conductor 48. The circuit is closed before tubing hanger 31 reaches an axial depth such that dogs 55 are below grooved profile 53. Axial position transmitter 49 receives electrical power from power supply 43, and in turn transmits a signal that is received by receiver 51. Receiver 51 transmits an electrical signal that is indicative of the axial position of axial position transmitter 49 to modem 41 in controller 39.

When axial position transmitter 49 reaches a predetermined depth location, which is typically within wellhead 11, modem 41 of controller 39 sends an electrical signal to actuate solenoid 67 from its contracted position (FIG. 3) to its extended position (FIG. 4). Solenoid 67 moves cam 61 axially upward, causing inclined face 63 to slidingly engage a lower portion of each of suspension dogs 55. Downward facing surface 65 prevents dogs 55 from moving axially upward with cam 61. Instead, suspension dogs 55 move radially outward to their radially outward position shown in FIG. 4 in response to inclined face 63 slidingly engaging dogs 55. Grooved profile 57 on the radially outward surface of dogs 55 engages grooved profile 53 of wellhead 11. Tubing hanger 31 is landed within wellhead bore 11 when dogs 55 engage grooved profile 53.

Figure 5:
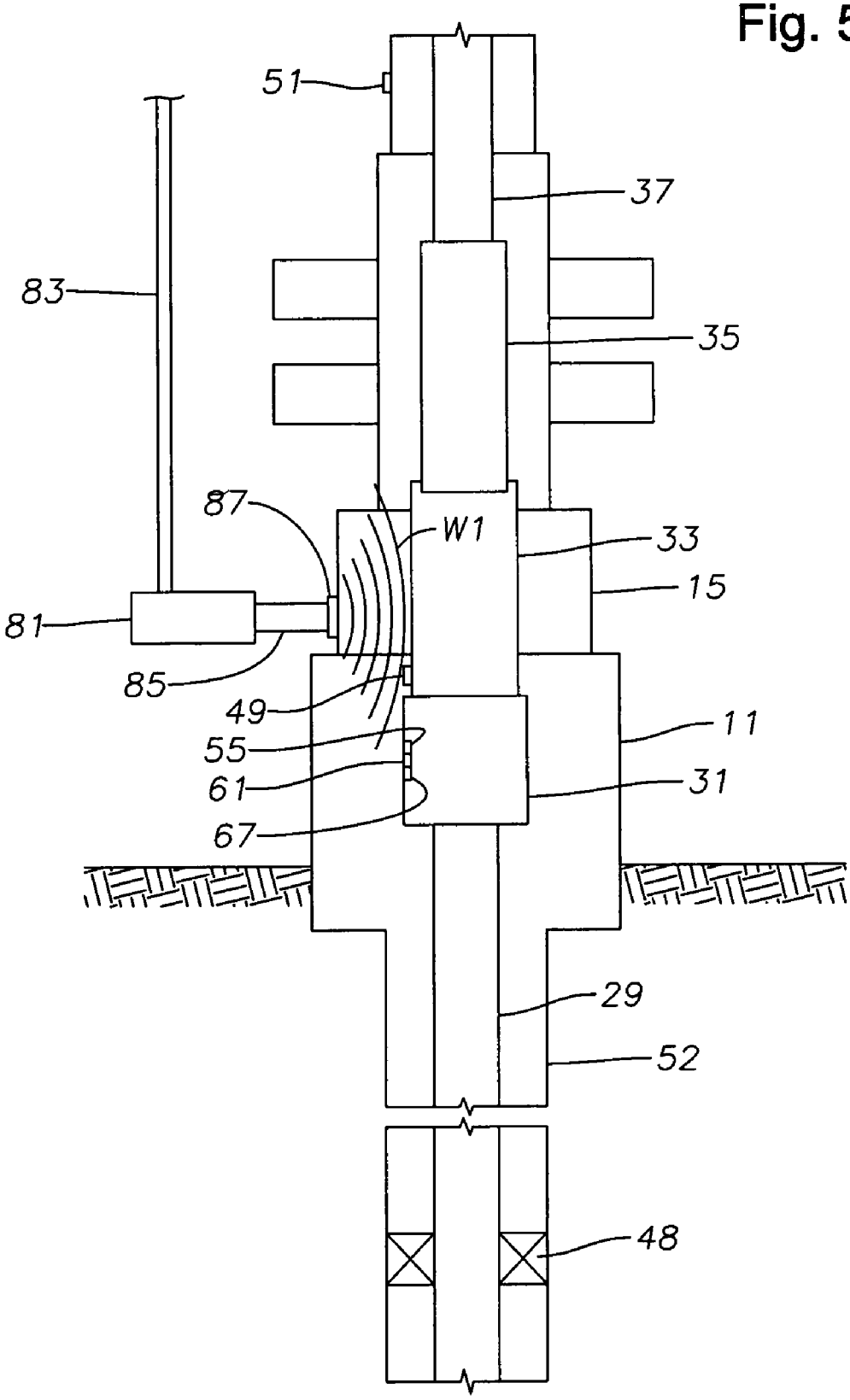
FIG. 5 is a schematic view of an alternative embodiment of a tubing hanger being run through a riser and wellhead system in accordance with an embodiment of this invention.

Referring to FIG. 5, additional embodiments using a remote operated vehicle or ROV 81 are disclosed for landing tubing hanger 31 in wellhead 11. ROV 81 is positioned adjacent wellhead 11 and has a control line 83 extending to the surface. An operator can control various functions of ROV 81 via control line 83. An ROV stab 85 extends from ROV 81 for connection with a stab receptacle 87. As shown in FIG. 5, stab receptacle 87 is part of adapter 15, however, those skilled in the art will readily appreciate that stab receptacle 87 can be located in various other parts of the wellhead assembly.

In one embodiment, receiver 51 senses and transmits signals pertaining to the axial position of axial position transmitter 49 as described above. In this embodiment however, solenoid 67 is an acoustically-actuated solenoid. When in the proper axial position for actuating suspension dogs 55, ROV 81 transmits an acoustical wave $W_1$ into the wellhead assembly to actuated solenoid 67.

Figure 6:
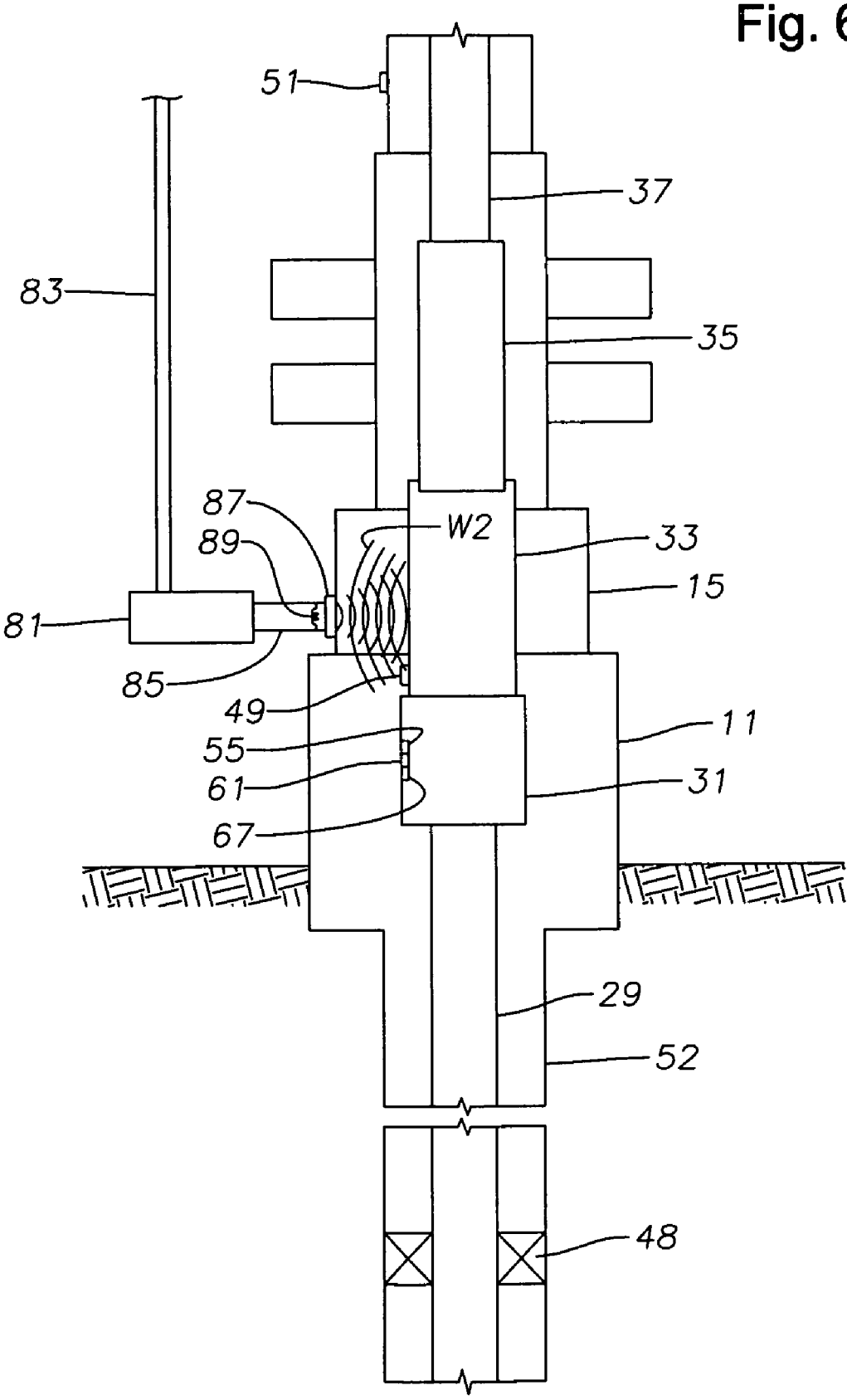
FIG. 6 is a schematic view of an alternative embodiment of a tubing hanger being run through a riser and wellhead system in accordance with an embodiment of this invention.

In another embodiment using ROV 81 shown in FIG. 6, an electric coil 89 is positioned within a portion of ROV stab 85. Electric coil 89 transmits a magnetic field wave $W_2$ into the wellhead assembly. As tubing 29, tubing hanger 31, and tubing hanger running tool 33 passes through electric field wave $W_2$ from electric coil 89, different signals are communicated to ROV 81. These signals can be based upon the presence of metal and the relative distance of the metal from electric coil 89. Therefore, operator can determine when there is a reduction of diameter from tubing hanger 31 to tubing hanger running tool 33. Additionally, in this embodiment, axial position transmitter 49 can comprise a magnetized material that would enhance or magnify the reaction to electrical field wave $W_2$. Dogs 55 can be actuated radially outward when tubing hanger 31 is in a predetermined axial location with either the electrically or acoustically actuated solenoids 67 as described above.

The assembly and methods described herein allow an operator to utilize narrower drilling risers and BOP systems than typically used in the past. Previous assemblies included tubing hangers that could not fit through such narrow risers because of the width of the orientation devices used to mechanically align the tubing hanger within the bore of the wellhead housing, and because of the width of the locking members that engage the bore of the subsea wellhead housing. The assembly and methods described herein also does not require the tubing hanger to be aligned for automatically, mechanically actuating locking members upon landing. Rather, the locking members remain retracted radially inward until at the correct axial position for being actuated to engage the grooved profile of the bore of the wellhead housing.

The assembly described herein is configured to permit drilling and completion through a slim bore riser, typically comprising commercially available well casings, with a BOP positioned at or near the surface or subsea, while accommodating large bore completions.

While the invention has been shown in only some of its forms, it should be apparent to those skilled in the art that it is not so limited, but susceptible to various changes without departing from the scope of the invention. For example, the process and equipment used for landing production tubing 29 and tubing hanger 31 can easily be utilized for landing casing hangers and intermediate strings of casing.

That claimed is:

1. A subsea well apparatus, comprising:

a subsea wellhead assembly having a bore containing an annular recess, the bore having a diameter below the recess that is at least equal to a diameter of the bore above the recess;

a riser extending from a subsea wellhead assembly to a vessel at the surface of the sea;

a pipe hanger having a string of pipe suspended therefrom, which is lowered through the riser with a string of conduit and into the bore of the subsea wellhead assembly;

a sensor positioned adjacent the subsea wellhead assembly, the sensor being positioned to monitor the axial position of the pipe hanger relative to the recess within the subsea wellhead assembly and to communicate the axial position of the pipe hanger to the surface; and a locking mechanism carried by the pipe hanger having a retracted position circumscribing a diameter smaller than the diameter of the bore below the recess, and a locked position in engagement with the recess to support weight of the pipe hanger and the pipe with the subsea wellhead assembly when the locking mechanism is in the locked position, the locking mechanism being selectively operable from the surface when the sensor indicates that the locking mechanism is aligned with the recess.

2. The apparatus of claim 1, wherein the sensor is attached to an outer periphery of the riser.

3. The apparatus of claim 1, wherein the sensor comprises an electromagnetic coil carried by a remote operated vehicle for applying an electromagnetic field into the wellhead assembly, the electromagnetic field changing in response to downward movement of the pipe hanger and a lower portion of the string of conduit through the electromagnetic field.

4. The apparatus of claim 1, wherein:

the locking mechanism comprises a plurality of locking members fully recessed within an annular groove formed in the outer circumference of the pipe hanger while in the retracted position.

5. The apparatus of claim 1, further comprising a running tool connected to the string of conduit and to the pipe hanger; and wherein the locking mechanism comprises:

an electrically-actuated solenoid mounted to the pipe hanger in electrical communication with the vessel, the solenoid having an extended position and a contracted position, the running tool being retrievable relative to the solenoid; and a plurality of locking members that matingly engage the recess in the wellhead housing assembly when actuated radially outward by the solenoid when the solenoid moves to the extended position, the solenoid being in the contracted position until the pipe hanger is lowered to a predetermined axial position and the solenoid is actuated to its extended position with an electrical current from the surface.

6. The apparatus of claim 1, further comprising:

a remote operated vehicle positioned adjacent the subsea wellhead assembly and having an acoustical transmitter that selectively transmits an acoustical wave into the subsea wellhead assembly; and wherein:

the locking mechanism comprises:

an acoustically-actuated device having an extended position and a contracted position; and a plurality of locking members that matingly engage the recess in the wellhead housing assembly when actuated radially outward by the acoustically-actuated device when the acoustically-actuated device moves to the extended position, the acoustically-actuated device being in the contracted position until the locking mechanism is lowered into alignment with the annular recess, and the acoustically-actuated device is actuated to its extended position when the acoustic wave is transmitted into the subsea wellhead assembly.

7. The apparatus of claim 1, further comprising:

a controller on the vessel, the controller having a power source, the controller having a first source terminal connecting to the string of conduit and a second source terminal connecting to the riser; and an electrical conductor positioned on the outer surface of the string of pipe that engages an interior surface of the subsea wellhead assembly, the subsea wellhead assembly, the riser, and the string of conduit being of electrically conductive metal, thereby completing an electrical circuit between the riser and the string of conduit for supplying power from the vessel to the sensor and the locking mechanism.

8. A subsea well apparatus, comprising:

a subsea wellhead assembly having a bore containing an annular recess formed therein, the bore having a minimum diameter below the recess that is at least as large as a minimum diameter of the bore above the recess;

a riser extending from a subsea wellhead assembly to a vessel at the surface of the sea;

a pipe hanger having a string of pipe suspended therefrom, which is lowered into the bore of the subsea wellhead assembly through the riser with a string of conduit;

an axial position sensor positioned adjacent the pipe hanger and in electrical communication with the vessel, the axial position sensor sensing and transmitting an axial position signal to the vessel to inform the vessel of the axial position of the pipe hanger relative to the annular recess; and a locking mechanism carried by the pipe hanger that has a retracted position circumscribing an outer diameter less than the minimum diameter of the bore below the recess and a locked position in engagement with the annular recess to support weight of the pipe hanger and the pipe, the locking mechanism being selectively operable from the vessel when the axial position sensor indicates that the locking mechanism is aligned with the annular recess.

9. The apparatus of claim 8, wherein the sensor is attached to an outer periphery of the riser.

10. The apparatus of claim 8, wherein the sensor is carried by a remote operated vehicle and comprises a coil that generates an electromagnet field into the wellhead assembly, and the string of conduit includes a magnetic device positioned a selected distance above the pipe hanger to provide an indication to the vessel when the magnetic device is within the electromagnetic field.

11. The apparatus of claim 8, further comprising:

a remote operated vehicle positioned adjacent the subsea wellhead assembly and having an acoustical transmitter that selectively transmits an acoustical wave into the subsea wellhead assembly; and wherein:

the locking mechanism comprises:

an acoustically-actuated solenoid having an extended position and a contracted position; and a plurality of locking members that matingly engage the annular recess of the wellhead housing assembly when actuated radially outward by the solenoid when the solenoid moves to the extended position, the solenoid being in the contracted position until the locking mechanism is lowered into alignment with the annular recess, and the solenoid being actuated to its extended position when the acoustic wave is transmitted into the subsea wellhead assembly.

12. The apparatus of claim 11, wherein the remote operated vehicle further comprises a stab and an electric coil housed within the stab, the electric coil transmitting a plurality of magnetic waves into the subsea wellhead assembly, the sensor receiving reflections of the magnetic field waves responsive to the pipe hanger being lowered into the subsea wellhead assembly in order to determine the axial position of the pipe hanger.

13. The apparatus of claim 12, wherein the pipe hanger is connected to the string of conduit with a pipe hanger running tool having a smaller outer diameter than the pipe hanger, and the sensor receives a variation in the reflections of magnetic waves reflecting from the outer surface of the pipe hanger than from the outer wall of the pipe hanger running tool, thereby signaling when the locking mechanism of the pipe hanger is in alignment with the annular recess.

14. The apparatus of claim 8, wherein:

the locking mechanism comprises:

a plurality of inwardly-biased locking members fully recessed within an annular groove formed in the outer circumference of the pipe hanger while in the retracted position; and a lock cam selectively movable between upper and lower positions, the lock cam having an inclined surface that engages the locking members to actuate the locking members radially outward when the lock cam moves to the upper position.

15. The apparatus of claim 14, further comprising a running tool connected with the string of conduit and with the pipe hanger; wherein the locking mechanism comprises:

an electrically-actuated solenoid mounted to the pipe hanger in electrical communication with the vessel, the solenoid being in contact with the lock cam to selectively move the lock cam between the upper and lower positions when the solenoid actuates between an extended position and a contracted position, the running tool being retrievable relative to the solenoid.

16. The apparatus of claim 8, further comprising:

a controller on the vessel, the controller having a power source, the controller having a first source terminal connecting to the string of conduit and a second source terminal connecting to the on the riser; and an electrical conductor positioned on the outer surface of the string of pipe that engages an interior surface of the subsea wellhead assembly, thereby defining an electrical circuit through the pipe hanger, the string of conduit, the wellhead assembly and the riser for supplying power from the vessel to the sensor, and the locking mechanism.

17. A method of landing a pipe hanger in a subsea well, comprising:

(a) providing a subsea wellhead assembly with a bore and an annular recess therein, wherein the bore has minimum diameter below the recess that is not less than a minimum diameter above the recess;

(b) extending a riser from the subsea wellhead assembly to a vessel at the surface of the sea;

(c) providing a pipe hanger with a locking mechanism having a retracted position that circumscribes a diameter less than the minimum diameter of the bore below the recess;

(d) lowering, with a string of conduit through the riser, the pipe hanger having a string of pipe suspended therefrom within the subsea wellhead assembly;

(e) monitoring the axial position of the pipe hanger within the subsea wellhead assembly with a sensor positioned a sensor adjacent the subsea wellhead assembly;

(f) communicating, with the sensor, the axial position of the pipe hanger to the surface; and (g) moving the locking mechanism from the retracted position to a locked position in engagement with the annular recess, thereby supporting weight of the pipe and the pipe hanger with the subsea wellhead assembly the locking mechanism being selectively operable from the surface when the sensor indicates that the locking mechanism is aligned with the annular recess.

18. The method of claim 17, wherein:

step (d) is performed by securing a running tool to the string of conduit and releasably connecting the pipe hanger to the running tool;

a solenoid is mounted to the pipe hanger and step (g) is performed by actuating the solenoid to an extended position, which causes a plurality of inwardly-bias locking members of the locking mechanism to move radially outward and engage the annular recess of the subsea wellhead assembly; and after performing step (g), the running tool is retrieved along with the string of conduit, leaving the solenoid mounted to the pipe hanger.

19. The method of claim 17, wherein:

steps (e) and (f) positioning a remote operated vehicle in engagement with a portion of the wellhead assembly, emitting an electromagnetic field into the wellhead assembly, and noting changes in the electromagnetic field as the string of conduit, pipe hanger and pipe are lowered into the wellhead assembly.

* * * * *